US005806132A

United States Patent [19]

Kelley

[11] Patent Number: 5,806,132

[45] Date of Patent: Sep. 15, 1998

[54] LOCKING COUPLER FOR FLOOR MAINTENANCE PAD

[75] Inventor: Patrick J. Kelley, Willoughby, Ohio

[73] Assignee: The Malish Corporation, Willoughby, Ohio

[21] Appl. No.: 668,694

[22] Filed: Jun. 24, 1996

Related U.S. Application Data

[63] Continuation-in-part of Ser. No. 447,391, May 23, 1995, abandoned.

[51] Int. Cl.[6] ..... A47L 11/162

[52] U.S. Cl. ..... 15/230.17; 15/98; 451/353

[58] Field of Search ..... 15/98, 230, 230.17, 15/230.19; 403/326, 327, 328, 329; 451/353, 508, 515, 516

[56] References Cited

U.S. PATENT DOCUMENTS

| | | | |
|---|---|---|---|
| 881,691 | 3/1908 | Hughes . | |
| 1,933,846 | 11/1933 | Finnel | 15/98 |
| 2,995,765 | 8/1961 | Ballato et al. . | |
| 3,270,467 | 9/1966 | Block et al. . | |
| 3,436,875 | 4/1969 | Cheney . | |
| 3,795,932 | 3/1974 | Young | 15/98 |
| 4,177,611 | 12/1979 | Carr-Rollett | 451/508 |
| 4,536,912 | 8/1985 | Malish . | |
| 4,541,207 | 9/1985 | Antonson . | |
| 4,662,024 | 5/1987 | Moench . | |
| 4,888,843 | 12/1989 | Smith et al. . | |
| 5,400,461 | 3/1995 | Malish et al. | 15/98 |
| 5,421,053 | 6/1995 | Chodak | 403/327 |
| 5,619,770 | 4/1997 | Bell | 15/98 |

FOREIGN PATENT DOCUMENTS

| | | | |
|---|---|---|---|
| 506319 | 5/1957 | Italy . | |
| 531058 | 12/1940 | United Kingdom | 15/98 |

OTHER PUBLICATIONS

"Modified Snap Ring Grips Polishing Pads", Design News, Nov. 5, 1984, pp. 174–177.

*Primary Examiner*—Terrence Till
*Attorney, Agent, or Firm*—Watts Hoffmann Fisher & Heinke

[57] ABSTRACT

A coupler is disclosed for coupling floor maintenance pads to a pad driven disc. The coupler has one part which is mounted to or from an integral part of the driver disc and a second part which snaps onto the first part for holding and centering a maintenance pad to a disc. A spring lock arrangement is provided for preventing the coupler from separating and comprises a spring clip carried by the retainer engageable with recesses formed on an axially extending locking post forming part of the base part. The spring clip is held to the retainer by a pair of keepers which define slots having diverging cross-sections. The spring clips include a pair of elongate legs interconnected by a bridging segment on one end and a pair of finger engageable pressure pads on opposite ends by which the spring clip is squeezed to spread apart the legs. Both the retainer and base include fluid supply openings through which floor treating fluids can be dispensed onto the floor. Alternate embodiments are also disclosed which include multi-stepped locking posts.

45 Claims, 6 Drawing Sheets

LOCKING COUPLER FOR FLOOR MAINTENANCE PAD

RELATED APPLICATION

This application is a continuation-in-part patent application of U.S. Ser. No. 08/447,391, filed May 23, 1995 entitled "LOCKING COUPLER FOR FLOOR MAINTENANCE PAD" now abandoned.

TECHNICAL FIELD OF THE INVENTION

The present invention relates to apparatus for securing a pad to a rotary floor machine of the type used in floor maintenance, and more particularly, a "snap together" coupler for securing a pad to a rotating driver disc of a floor maintenance machine.

BACKGROUND OF THE INVENTION

Coupler devices are well known for centering and coupling a floor maintenance pad to a pad driver disc. The pad driver disc is rotated by the drive shaft of a power-driven floor maintenance machine. One example of such a coupling device is illustrated and described in U.S. Pat. No. 4,536,912.

A pad coupler device typically has two parts, one of which is secured to the pad driver and the other of which is removable and is used to secure the pad to the pad driver. Various methods for maintaining the engagement between the pad driver mounted portion and the retainer portion have been suggested for use in the prior art. For example, the two parts may have threaded portions which interengage in order to secure the retaining portion to the pad driven portion. An example of a threaded engagement is illustrated in U.S. Ser. No. 08/184,392, filed Jan. 21, 1994 now U.S. Pat. No. 5,400,461.

Other coupling structures have also been disclosed in the prior art. For example, in U.S. Pat. No. 4,541,207, a "pull-apart" design is illustrated. In the construction shown in this patent, interengaging lips are used to releasably secure a "split-ring" retainer to a base. In the disclosed coupling device, friction and elasticity are relied upon to maintain engagement of the members.

Since the pads of a floor cleaning machine are replaced frequently due to wear or the need to use a pad with different abrasive characteristics, it is important that the retainer portion of the coupling device be easily released. In many of the prior art devices, release of the retainer from the base in order to release the pad from the pad driver can be difficult. In some constructions that provide easy release of the retainer, the coupling is not as reliable as desired.

DISCLOSURE OF THE INVENTION

The present invention provides a new and improved coupling device for securing a pad to a drive disc of a floor maintenance machine. In particular, the invention comprises a "snap together" coupling device which includes a base mountable coaxially to the drive disc, having a centrally positioned, axially extending post. A retainer defines centering structure for the post by which the retainer is centered with respect to the base. A retaining mechanism preferably carried by the retainer is engageable with the post of the base, whereby the retainer is held to the base.

In the preferred and illustrated embodiment, the post includes a perimeter recess and the retaining element includes resilient portions engageable with the recess. Preferably, the recess is defined by a shoulder or groove formed a spaced distance from an outer end of the post and the portions of the resilient element engageable with the groove comprise elongate arms of a spring clip mounted to the retainer. Preferably, one end of each elongate arm of the spring clip is connected to a bridging segment. In the preferred and illustrated embodiment, the bridging section comprises a length of spring wire and thus, the spring clip has a U-shaped configuration. A bridging segment, however, may take other forms, such as circular segment or a loop of spring wire. Opposite ends of the elongate arms define finger engageable pressure pads by which the spring clip is squeezed in order to spread apart the legs in order to provide sufficient clearance to enable the post of the base to pass through the legs of the spring clip.

The retainer includes a pair of laterally extending, spring keepers which are disposed on opposite sides of a centerline of the retainer. The keepers define centering surfaces engageable with the post, as well as slots for holding at least portions of the spring clip. In the preferred embodiment, each slot, defined by a keeper, increases in cross-sectional area from an inner region (nearest the centerline of the retainer) to an outer region. This increase in cross-section provides added clearance for the clamping legs of the spring clip when the legs are spread apart in order to provide clearance for the post of the base.

According to a feature of the invention, both the base and the retainer include tines which project in the axial direction from a pad engaging surfaces of the retainer and base. When the coupler is assembled, the tines pierce the portion of the pad clamped between the flanges of the base and the retainer and inhibit stretching of the pad due to centrifugal forces exerted on the pad when the pad is rotated by the floor maintenance machine.

With the disclosed snap-together coupling device, machine pads can be easily removed and re-installed onto a floor maintenance machine. To remove the retainer from the base, the legs of the spring clip are squeezed in order to spread apart the legs. When the legs are spread to a dimension larger than the diameter of the post, the retainer can be easily moved in an axial direction off the post. A machine pad is then placed in position on the base and the retainer is then pushed back onto the base. The post preferably includes a chamfered or cone-shaped end surface which acts to cause the legs of the spring to spread apart as the retainer is pushed onto the post. The legs of the spring retainer then snap into the recess defined by the post.

According to another feature of the invention, both the retainer and the base include fluid supply openings through which solutions, such as cleaning solutions can be dispensed into the rotating path of the machine pad. As is known, some cleaning machines include a fluid dispenser for dispensing treatment fluids, such as detergents and polishes. Typically, the dispenser deposits fluid onto the upper surface of a pad driver (to which the base of the coupler is attached). With the present invention, fluid supply openings in the coupler allow solution to flow from the dispenser and onto the floor. With the disclosed arrangement, fluid can easily be directed to the region between the floor pad and the floor.

According to another feature of the invention, the base includes a depending, circular wall which is engageable with complementally formed structure on the retainer which serves to generally center the retainer on the base. Preferably, the retainer includes a circular wall having a diameter less than the wall of the base part, so that it fits within and in confronting relation to the depending wall formed on the base.

According to another preferred embodiment of the invention, the locking post preferably forming part of the base, includes structure which enables pads having a wide range of thicknesses to be clamped between the retainer and the base. In one embodiment, the locking post includes two axially spaced recesses either of which can be engaged by the legs of the spring clip. A head portion of this multi-stepped post includes a tapered surface for camming the legs of the locking spring outwardly to facilitate engagement of the locking spring with the first recess. A tapered surface is also associated with the second recess which facilitates spreading of the legs of the retaining clip to enable the legs of the spring clip to move out of the first recess and into the second recess, which is located intermediate the head of the locking post and an inner end or foot of the post.

According to another embodiment, the locking post includes three steps or recesses that are engageable by a retaining member held by the retainer. In this embodiment, the profile of the post is tapered with the foot of the post being larger in diameter than the head portion of the post.

By using multiple steps on the locking post, a wider range of pad thickness can be accommodated by a given combination of retainer and base. In use, a pad is placed on the base portion of the coupler, which is attached to the floor machine. The retainer is then pushed onto the base. As the retainer moves axially towards the base, the legs of a spring retainer are spread apart by the tapered surface of the head portion of the locking post, enabling the legs to move into engagement with the first recess. If the pad permits additional axial movement of the retainer portion of the base, subsequent tapered surfaces for the intermediate recesses spread apart the legs of the retaining element enabling the retaining element to engage one of the inner recesses.

The present invention also contemplates other locking post configurations. In particular, the post may include more than three steps if dimensions permit. In addition, the present invention contemplates multiple locking posts, as well as coupler configurations in which the retaining element (which is preferably a spring clip) is held by the base and the locking post forms part of the retainer.

Additional features of the invention will become apparent and a fuller understanding obtained by reading the following detailed description made in connection with the accompanying drawings.

DESCRIPTION OF THE PREFERRED EMBODIMENTS

Figure 1:
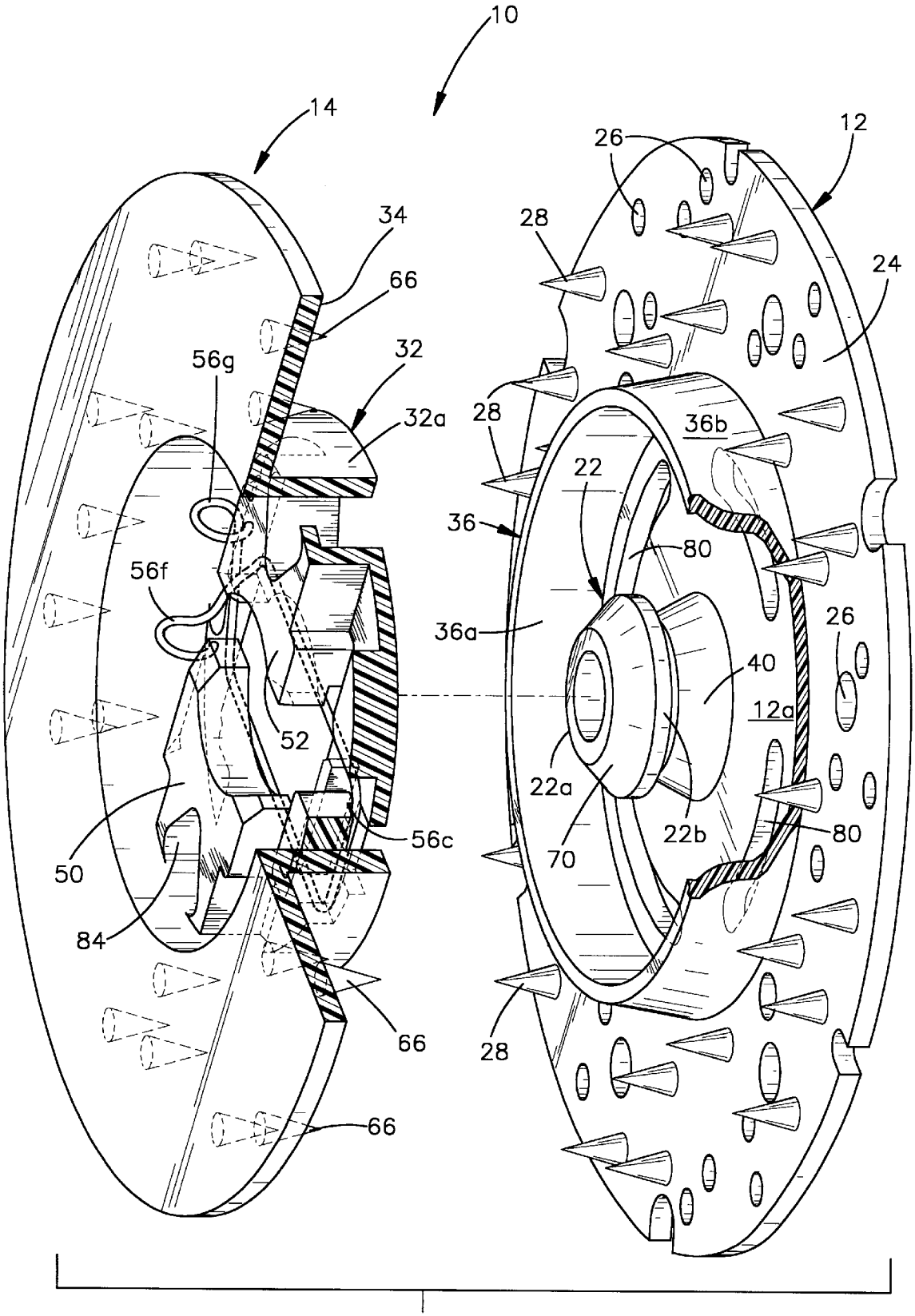
FIG. 1 is an exploded perspective view of a floor maintenance machine coupler of the present invention.
Figure 2:
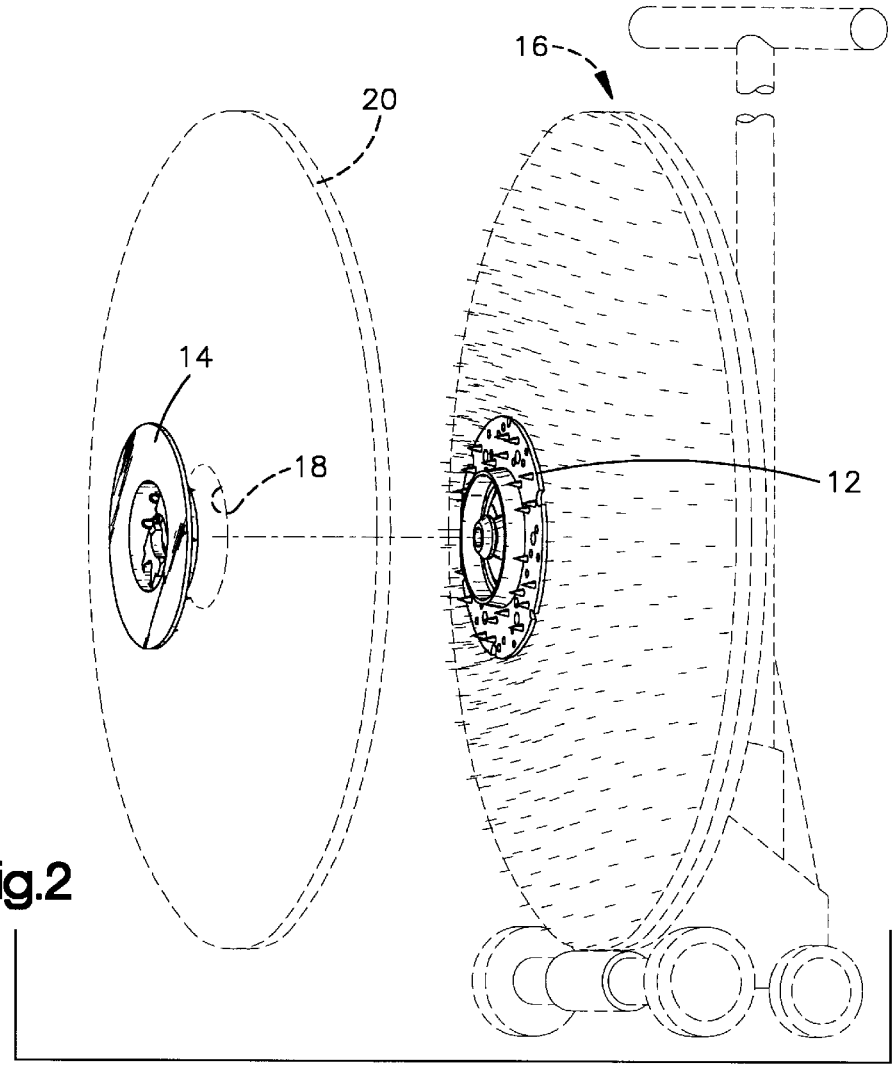
FIG. 2 is an exploded perspective view of a coupler mounted to a floor maintenance machine.

Referring to FIG. 1, a coupler 10 is shown which has a base 12 and a retainer 14. As seen in FIG. 2, the base 12 is coaxially attached to a pad driver disc 16. A portion of the retainer 14 extends through a circular mounting hole 18 of a floor maintenance pad 20 and, as will be described, "snaps" onto the base 12. The coupler 10 centers and holds the pad 20 to the disc 16 when in its coupled state. In the machine illustrated in FIG. 2, the pad driver 16 engages the upper surface of the pad 20 with a plurality of bristles which operate to spring the pad for a variety of floor maintenance operations such as polishing, burnishing, scrubbing and stripping. Each separate task requires a pad 20 with particular abrasive characteristics. Due to the "snap together" feature of the disclosed pad coupler, the retainer 14 is readily uncoupled from the base 12 to permit an operator to replace the pad 20.

The base 12 has a locking post 22 and a flange 24 extending radially outward from one end of the post 22. The flange has a plurality of screw holes 26 formed in its surface for attaching the base to the driver disc 16 with screws. Numerous holes 26 are provided in various patterns to make the base 12 compatible with all conventional types of pad drivers 16. A plurality of tines 28 are formed on the side of the flange 24 facing away from the driver disc 16. The tines 28 project in the axial direction of the post 22 and pierce the pad 20 and hold it in position. The tines 28 serve to prevent the pad 20 from outward stretching during high speed operation due to the influence of centrifugal force.

The retainer 14 includes a hub 32 and a radial extending flange 34. As will be described, the hub 32 of the retainer 14 includes structure for aligning with the locking post 22 of the base 12. The retainer defines a continuous, outer circular wall surface 32*a*. The base, on the other hand, defines an axially extending wall 36 having an inner wall surface 36*a* which, in the preferred embodiment, is continuous. The diameter of the wall 32*a* is sized such that it fits within the wall 36 formed on the base. The wall surfaces 32*a*, 36*a* are in a confronting relationship when the coupler is assembled, i.e., when the retainer 14 is snapped onto the base 12. An outer surface 6*b* of the wall 36 is sized to engage the circular opening 18 defined in the pad 20 thus centering the pad 20 with respect to the base 12.

Figure 6:
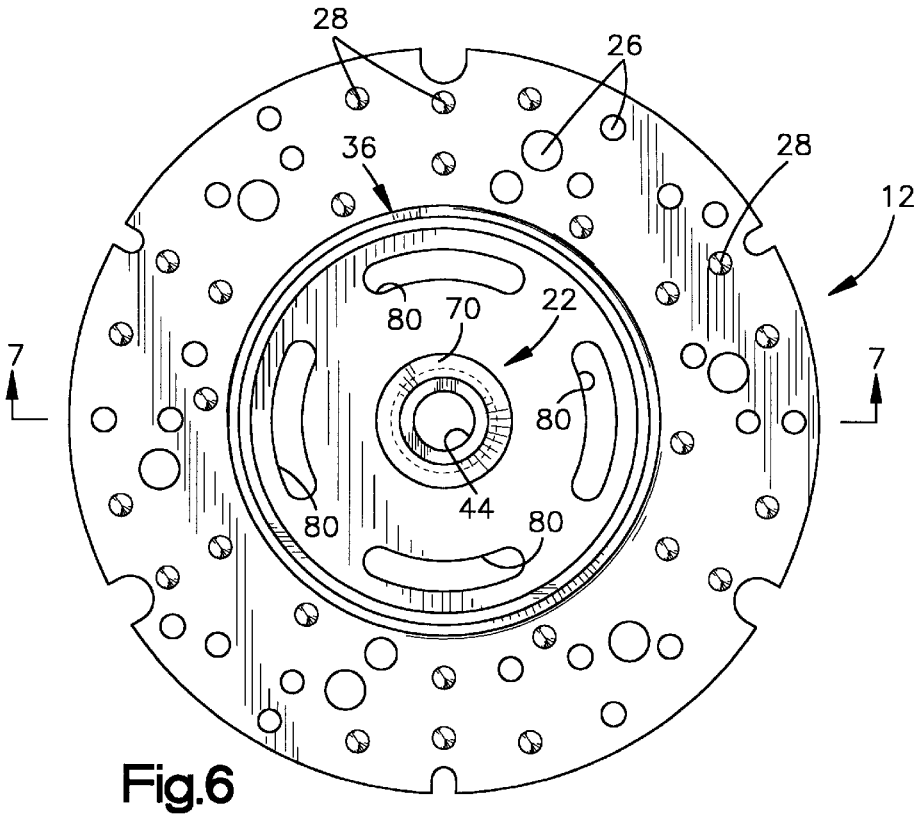
FIG. 6 is a bottom plan view of a base of the coupler shown in FIG. 1.
Figure 7:
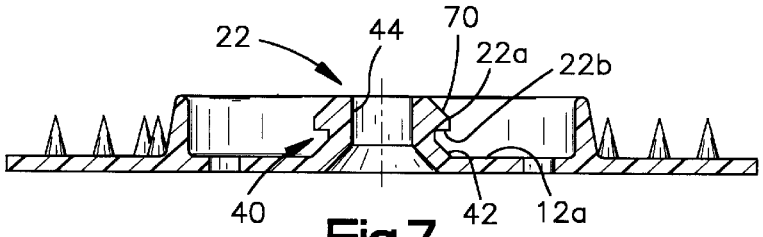
FIG. 7 is a cross sectional view of the base of FIG. 6 as seen approximately from the plane indicated by the line 7—7 in FIG. 6.

Referring also to FIGS. 6 and 7, the locking post 22 extends centrally from the base 12. As seen best in FIG. 7, the locking post 22 includes a head portion 22*a*. An undercut or shoulder 22*b* defines a narrow diameter region which forms a locking groove or recess 40 engageable by a locking element carried by the retainer 14. In the preferred embodiment, a tapered or cone surface 42 joins the locking recess 40 with a planar plate section 12*a* of the retainer 12. In the illustrated embodiment, the post 22 includes a central bore 44.

Figure 4:
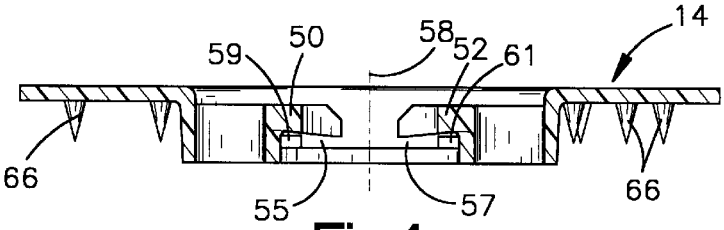
FIG. 4 is a cross sectional view of the retainer of FIG. 3 as seen approximately from the plane indicated by the line 4—4 in FIG. 3.
Figure 5:
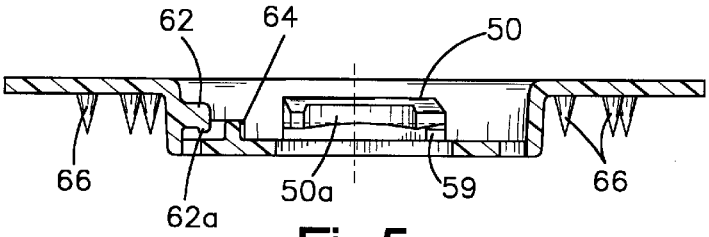
FIG. 5 is a cross sectional view of the retainer of FIG. 3 as seen approximately from the plane indicated by the line 5—5 in FIG. 3.
Figure 3:
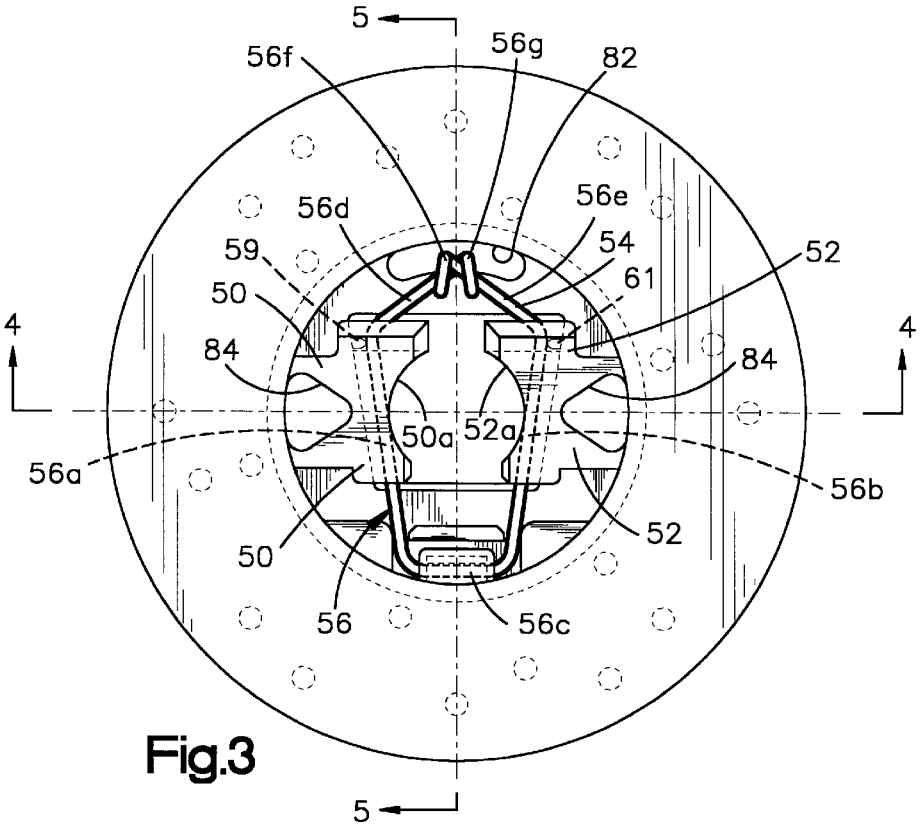
FIG. 3 is a bottom plan view of a retainer of the coupler of FIG. 1 with a retaining spring shown in a released position.

Referring to FIGS. 3, 4 and 5, the retainer 14 includes a pair of laterally extending keepers 50, 52 which secure a locking clip 56 (shown in FIG. 3). As seen best in FIG. 4, the keepers 50, 52 are in a confronting relationship and are located on either side of a central axis 58 of the retainer 14. The keepers 50, 52 have a cross-section that decreases as a function of the distance from the center line 58. As a result, recesses 55, 57 each having an increasing cross-section are defined within which portions of the locking clip 56 are captured.

As seen in FIG. 3, each keeper 50, 52 includes an arcuate segment 50*a*, 52*a*, which together define an opening that is slightly greater than the diameter of the post 22. The arcuate segments 50*a*, 52*a* center the head 22*a* of the post 22 with respect to the retainer 14, but sufficient clearance is provided to enable the post 22 to easily slide between the arcuate segments of the keepers 50, 52.

Figure 8:
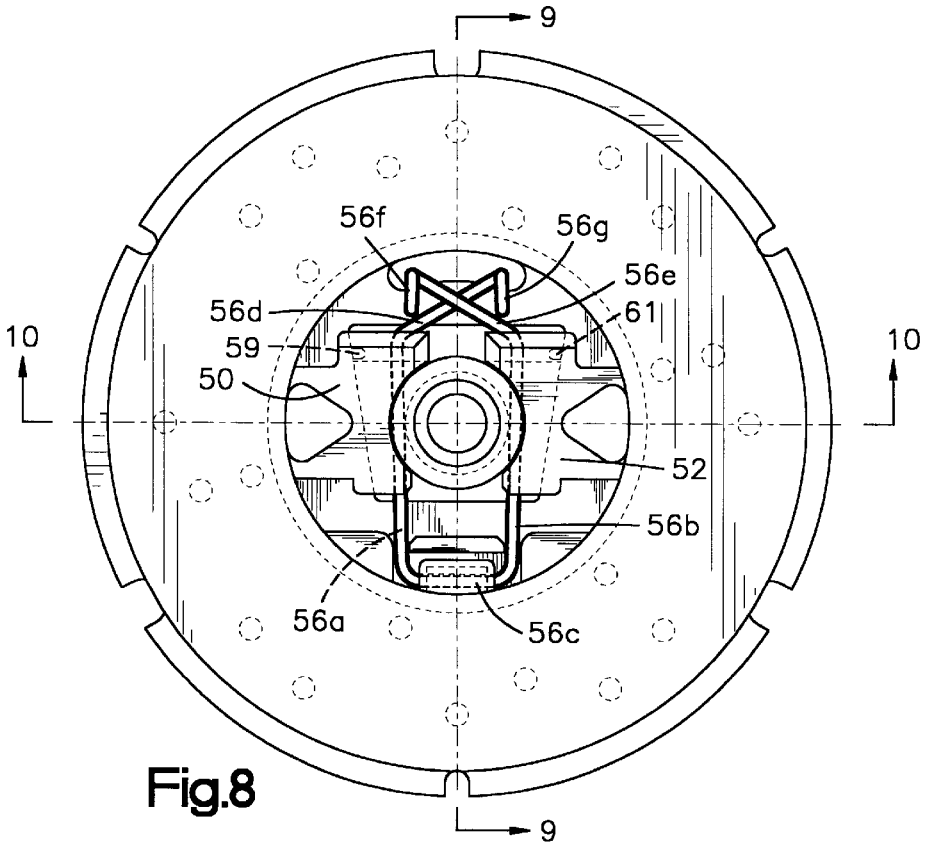
FIG. 8 is a bottom plan view of the assembled coupler.

In the preferred and illustrated embodiment, the locking clip 56 is constructed of spring wire and includes a pair of elongate clamping legs 56*a*, 56*b* having inner ends that extend from a bridging segment 56*c* such that a generally U-shaped configuration is defined. It should be understood, that the substantially straight bridging segment 56*c*, shown in the illustrated embodiment, may be replaced by other configurations, such as an arcuate spring wire segment, or a loop of spring wire. Opposite ends of the locking legs 56*a*, 56*b* are each bent to form angled, crossover segments 56*d*, 56*e*. The legs each terminate in a eyelet shaped loops 56*f*, 56*g* which define finger engageable pressure pads. As should be apparent from viewing FIG. 8, squeezing the pressure pads urges the locking legs 56*a*, 56*b* apart, as shown in FIG. 3. With the legs spread apart, the post 22 from the base 12 can easily pass through and into the opening defined between the arcuate segments 50*a*, 52*a* of the keepers 50, 52.

In the preferred and illustrated embodiment, each of the keepers define respective spring stops 59, 61 which are engageable by respective locking legs 56*a*, 56*b*. The purpose of the spring stops is to prevent the spring retainer 56 from being expanded to a point where pressure pads cross over each other and result in the spring clip being locked in the expanded position.

Figure 9:
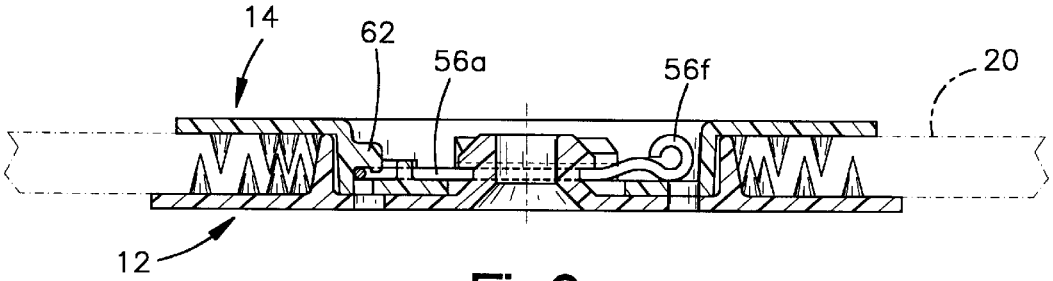
FIG. 9 is a cross sectional view of the coupler of FIG. 8 as seen approximately from the plane indicated by the line 9—9 in FIG. 8.

The bridging segment 56*c* of the spring clip 56 is captured between a supplemental, laterally extending keeper 62 (see FIG. 9) and an upstanding wall segment 64 best shown in FIG. 5. Preferably the supplemental keeper 62 includes a downwardly extending lip 62*a*, which defines a slot slightly smaller than the diameter of the spring wire that forms the bridging segment 56*c*. Once the bridging section 56*c* is forced past the lip 62*a*, it is captured in a recess defined by the supplemental keeper 62 and its movement out of the recess is inhibited by the lip 62*a*. The upstanding wall 64 is dimensioned to be similar to the dimension of the bridging section 56*c* and serves to maintain the location of the clip by inhibiting side-to-side movement of the bridging segment 56*c*.

The spring clip 56 provides a simple and cost effective retaining mechanism for maintaining engagement between the retainer 14 and the base 12. However, other constructions may be employed for the retaining mechanism. For example, resilient locking members engageable with the recess 40 formed in the post 22, may be molded into the retainer eliminating the need for a separate spring clip. It should also be understood that other spring clip configurations could be used to provide the locking engagement with the recess 40 defined by the post 22.

Figure 10:
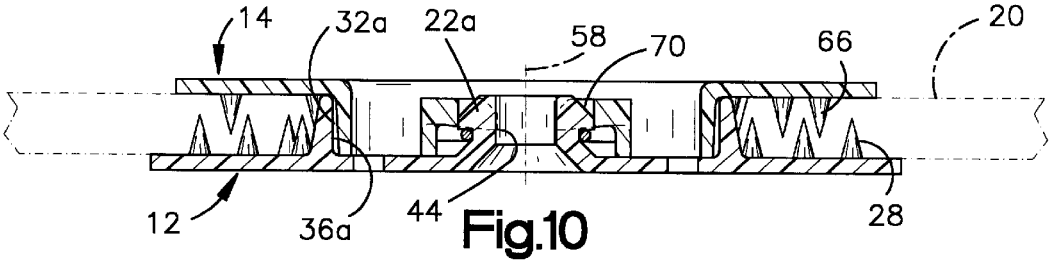
FIG. 10 is a cross sectional view of the coupler of FIG. 8 as seen approximately from the plane indicated by the line 10—10 in FIG. 8.

A plurality of tines 66 similar to the tines 28, are formed on the side of the flange 34 of the retainer 14 that faces the driver disk 16. Like the tines 28, the tines 66 project in the axial direction and pierce the pad 20. As seen best in FIG. 10, the tines 28, 66 extend towards each other and tightly grip the portion of the pad 20 captured between the base and retaining flanges 24, 34 and substantially reduce the chances of the pad 20 stretching during high speed operation due to centrifugal force.

The coupler of the present invention is used as follows. The base 12 is attached to the driver disk 16 using suitable fasteners such as screws. The holes 26 accommodate a wide variety of bolt patterns. The pad 20 is then placed onto the base 12 such that the axial wall 36 of the base extends through the center hole 18 thus centering the pad with respect to the base. The retainer 14 is then "snapped" on to the base thereby clamping the pad 20 between the flange 34 of the retainer and the flange 24 of the base. Specifically, the retainer 14 is generally aligned with the base and is pushed in an axial direction towards the base. A chamfered or other tapered surface 70 of the post 22 engages and spreads apart the locking legs 56*a*, 56*b* of the spring clip 56 which then allows the head 22*a* of the post 22 to move past the spring clip 56 and enter the opening defined between the arcuate segments 50*a*, 52*a* of the keepers 50, 52. As the head 22*a* moves past the spring legs, the legs 56*a*, 56*b* spring towards each other (contract) and enter the groove or recess 40 defined below the shoulder 22*b* of the post 22. Engagement between the legs and the shoulder locks the retainer to the base and thus clamps the pad 20 between the flanges 24, 34.

To release or separate the retainer from the base, the finger tabs 56*f*, 56*g* of the spring clip 56 are squeezed towards each other thus spreading the locking legs of the spring clip. When they are spread to a distance greater than the diameter of the head 22*a* of the post 22, the post is released allowing the retainer 14 to separate from the base.

According to a feature of this invention, the coupler provides fluid supply openings so solution such as cleaning solutions can be dispensed onto the floor. Specifically, the base includes a plurality of elongate, arcuate slots 80 which allow a solution dispensed from a machine dispenser located above the rotating pad (not shown), to flow through the base. The retainer includes several openings through which fluid can pass. In the illustrated embodiment, the retainer includes at least one arcuate, elongate opening 82 similar in shape to the slots 80 formed in the base member. In addition, each keeper 50, 52 defines an opening 84 as well. With the disclosed construction, a solution such as a cleaning solution dispensed from a dispenser mounted to the machine and above the rotating pad, can flow through the slots 80 formed in the base 12 and then through the slot and openings 82, 84 formed in the retainer 14 and then onto to the floor.

Figure 12:
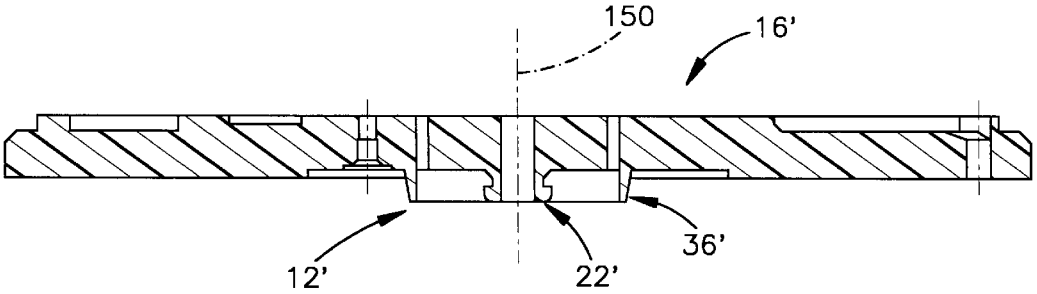
FIG. 12 is a cross sectional view of the driver disc of FIG. 12 as seen approximately from the plane indicated by the line 12—12 in FIG. 11.
Figure 11:
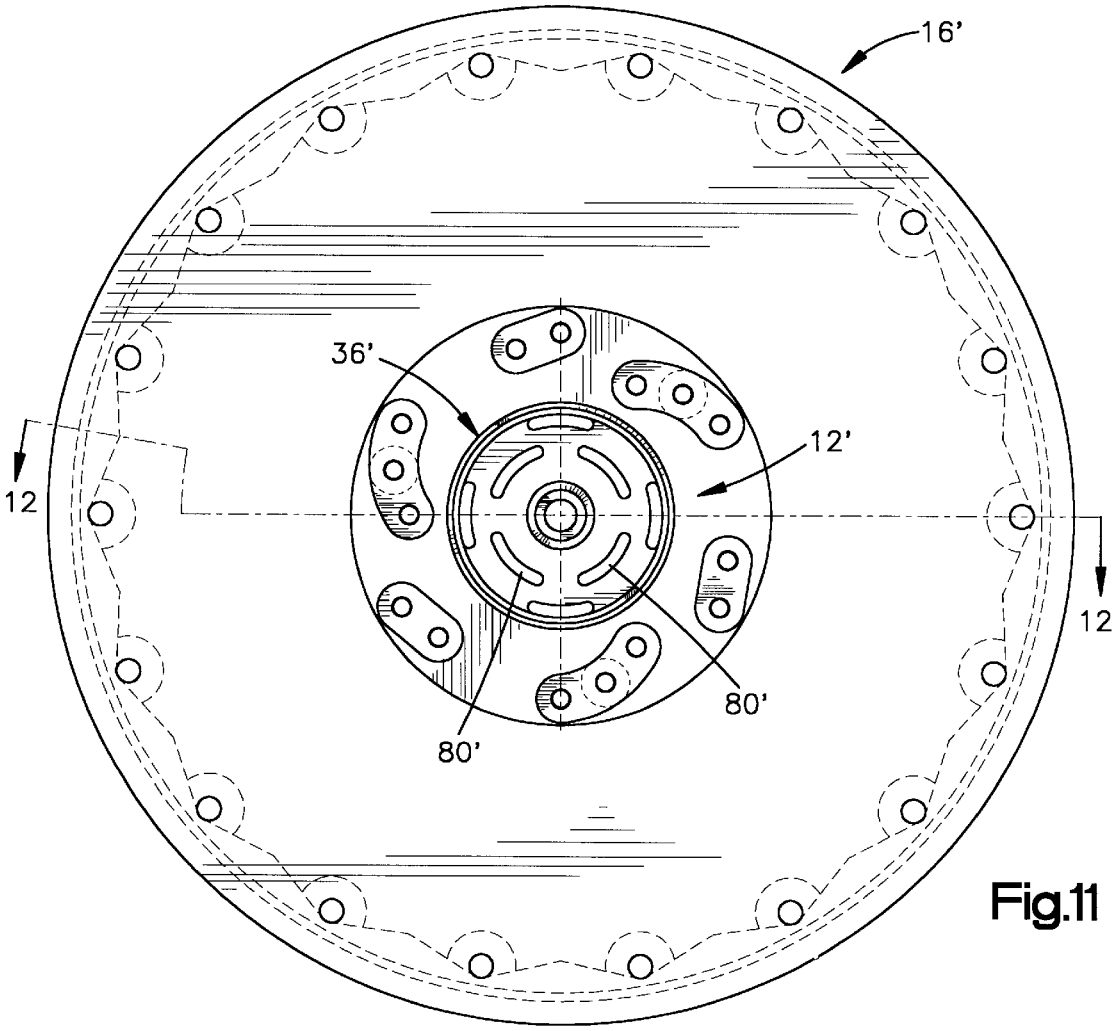
FIG. 11 is a plan view of a pad driver disc incorporating the present invention.

FIGS. 11 and 12 illustrate another embodiment of the present invention. In this embodiment, the base of the coupler is integrally molded into the pad driver disc. In particular, the illustrated pad driver disc 16' defines base structure 12'. The base structure 12', as seen best in FIG. 12, includes an axially extending post 22', which is preferably configured the same as the post 22 forming part of the FIG. 1 embodiment. The integrally formed base 12' also defines an axial wall or hub 36' which cooperates with the wall 32 (shown in FIG. 1) defined by the retainer 14. The base 12' defines an axis for rotation 150 which is coincident with an axis of rotation for the pad driver disc 16'. The integrally formed base 12' also includes arcuate slots 80' which allow solution dispensed from a machine dispenser to flow through the base portion 12.

Figure 13:
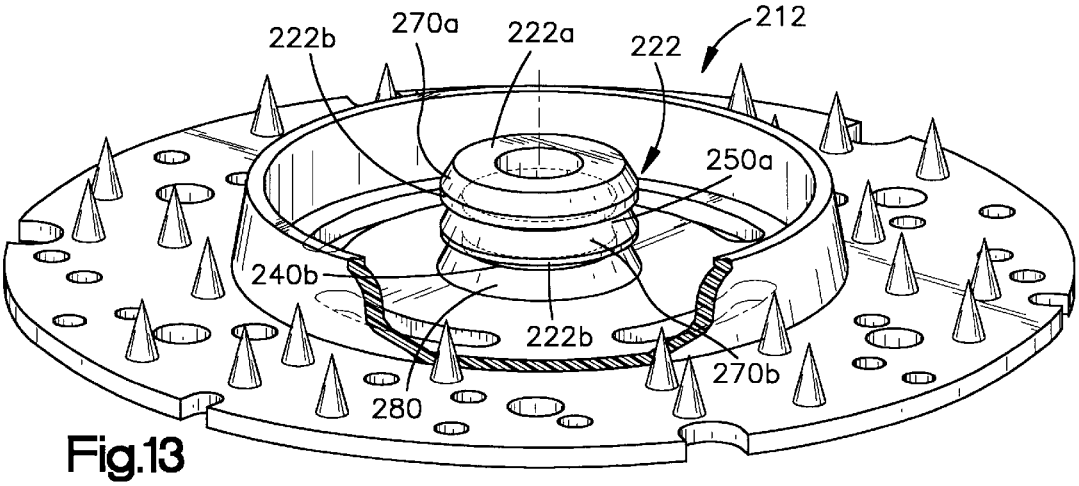
FIG. 13 is a perspective view of a base constructed in accordance with another embodiment of the invention.
Figure 14:
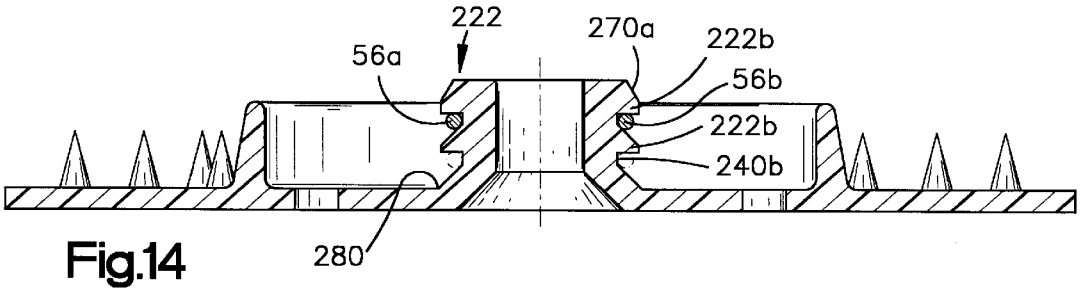
FIG. 14 is a sectional view of the base shown in FIG. 13.

FIGS. 13–16 illustrate other embodiments of the invention. In particular, these figures illustrate alternate constructions for the locking post (element 22 in FIGS. 1–10). Turning first to FIGS. 13 and 14, a base 212 is illustrated which includes a two step locking post 222 extending axially and having a head portion 22*a* and a foot 280. The locking post 222 includes a head portion 222*a* and two undercuts or shoulders 222*b* which each define a narrow diameter region that forms adjacent locking grooves or recesses 240*a*, 240*b*. Either of the recesses 240*a*, 240*b* can be engaged by the locking element 56 held by the retainer 14 (shown in FIG. 1). The multiple recesses 240*a*, 240*b* enable the retainer 14 to engage the base at two different axial positions. This enables the combination of retainer 14 and base 212 to accommodate pads having a wider range of thicknesses (as compared to the range of pad thicknesses that can be accommodated by the embodiment of FIG. 1), thus increasing the efficacy of the invention.

The post 222 includes a tapered surface 270*a*, which as in the FIG. 1 embodiment serves to engage and spread apart the locking legs 56*a*, 56*b* of the spring clip 56, which facilitates and engagement of the retainer with the base. A second tapered surface 270*b* is formed on the lower shoulder 222*b*, below the recess 240*a* (as viewed in FIG. 13) and facilitates the engagement of the spring clip 56 with the groove 240*b*, if the thickness of pad being clamped permits sufficient axial movement between the retainer and the base. In use, a pad to be clamped to the floor cleaning machine is positioned on the base 212 and the retainer is then aligned with and pushed axially towards the base. The legs 56*a*, 56*b* of the spring clip 56 of the retainer 14 are spread apart first by the tapered surface 270*a* allowing the legs of locking clip to move past the head portion 222*a* of the post 222. If the thickness of the pad permits, the retainer is further pushed axially, towards the base so that the tapered surface 270*b* spreads apart the legs of the locking clip 56 allowing the post to move an additional distance relative to the retainer, allowing the legs 56*a*, 56*b* of the locking clip to engage the lower recess 240*b* (as viewed in FIG. 13).

Figure 15:
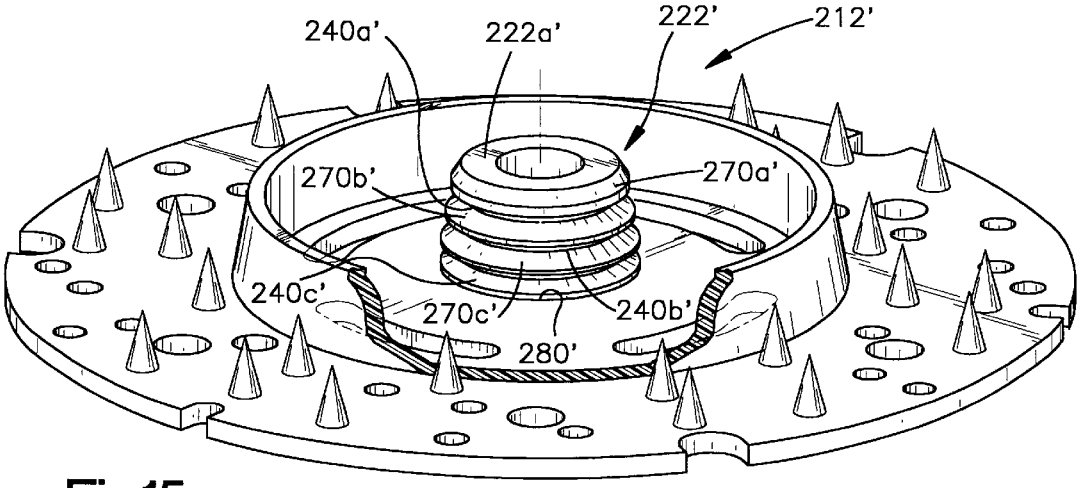
FIG. 15 is a perspective view of a base constructed in accordance with still another embodiment of the invention; and, FIG. 16 is a sectional view of the base shown in FIG. 15.
Figure 16:
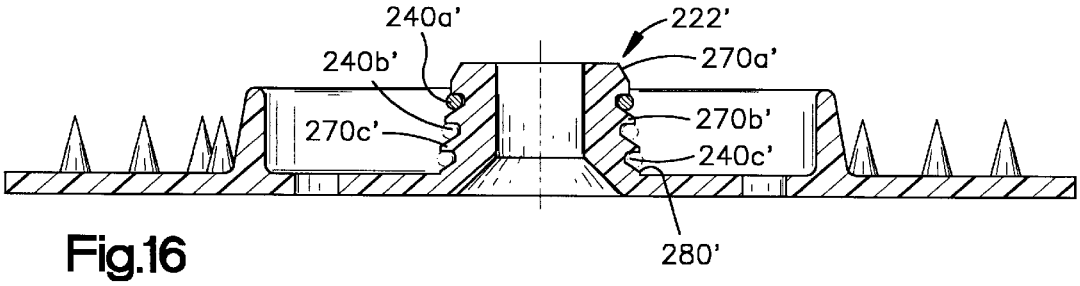

Turning next to FIGS. 15 and 16, an alternate embodiment to the embodiment shown in FIG. 13 is illustrated. In the FIG. 15 embodiment, a base 212' includes a three stepped locking post 222'. In the illustrated arrangement, the locking post includes three undercuts which define three narrow diameter regions or recesses 240*a'*, 240*b'*, 240*c'*. As seen best in FIG. 16, the overall locking post 222' has a tapered cross section with the diameter decreasing from a foot 280' of the post 222' to the head portion 222*a'*. As a result, the locking recess 240*c* has a slightly larger diameter than the locking region 240*b'* which in turn has a slightly larger diameter than the uppermost locking recess 240*a'*. The locking post 222' includes three tapered or chamfered surfaces 270*a'*, 270*b'*, 270*c'*, which as in the case of the FIG. 1 and FIG. 13 embodiments, act as camming surfaces to facilitate the engagement of the locking clip 52 with an associated recess. By aligning the retainer 14 with the base 222' and pushing the retainer towards the base, the camming surface operates to spread apart the locking clip legs to enable the post to move relative to the retainer and allow the legs to engage a recess. The final position of the retainer relative to the base is determined by the thickness of the pad that is clamped between the base 222' and retainer. The embodiment illustrated in FIG. 15 accommodates an even wider range of pad thicknesses than the embodiment shown in FIG. 13.

In addition to the arrangements shown in FIGS. 1–16, which in general illustrate locking posts positioned centrally or on a rotational axis of the base, the invention also contemplates construction which utilizes one or more locking posts positioned on the base at other than the rotational axis of the base.

In both embodiments, the retaining mechanism for maintaining engagement between the base portion and the retainer portion is shown as being carried by the retainer portion. It should be understood by those skilled in the art, that the structure may be reversed such that the locking element is carried and/or forms part of the base and the elongate post engaged by the locking element may form part of the retainer portion.

It should be apparent, that the present invention provides a coupler that greatly facilitates the removal and reinstallation of a pad onto a cleaning machine. The self-centering feature of the retainer allows the operator to simply snap on the retainer when mounting a pad. Special tools or auxiliary fasteners are not needed. In addition, cleaning and other solutions can easily be fed from the machine to the floor during machine operation vis-a-vis the openings formed in the base and the retainer.

Although the invention has been described with a certain degree of particularity it should be understood that those skilled in the art can make various changes to it without departing from the spirit or scope of the invention as hereinafter claimed.

I claim:

1. A snap together coupling device for mounting a floor maintenance pad having a circular mounting hole to a drive disc on a power driven floor maintenance machine, the coupling device comprising:

a) a base part mountable co-axially to the drive disc and having a substantially rigid, centrally positioned, axially extending post, said post defining an engagement structure located on an outside surface of said post, said outside surface being radially outward with respect to an axis of rotation of said drive disc;

b) a retainer part defining base receiving structure whereby said retainer part is centered with respect to said post;, c) a retaining mechanism carried by said retainer part and engageable with said post whereby said base part is inhibited from separating from said retainer.

2. The apparatus of claim 1, wherein said engagement structure on said post includes a shoulder and said retaining mechanism comprises a resilient element having portions engageable with an underside of said shoulder.

3. The apparatus of claim 2, wherein said retainer part further comprises a pair of laterally extending keepers located in a confronting relationship and on opposite sides of a centerline of said retainer part, said keepers operating to maintain a position of said retainer mechanism.

4. The apparatus of claim 3, wherein said keepers define recesses, said recesses increasing in cross-section from a radially inner region of said retainer part to a radially outer region of said retainer part.

5. The apparatus of claim 4, wherein said retaining mechanism comprises a U-shaped spring having a pair of engagement legs interconnected by a bridging portion and further including elements by which pressure is applied to urge said leg portions away from each other in order to disengage the shoulder formed on said post, whereby said retainer part is released from said base part.

6. The apparatus of claim 3, wherein said laterally extending keepers include stops for limiting movement of portions of said retainer mechanism to a predetermined range.

7. The coupling device of claim 1 wherein said base part has a plurality of tines projecting in an axial direction with respect to said post for piercing said pad.

8. The apparatus of claim 1, wherein said engagement structure on said post includes a recess engageable by post engaging portions of said retaining mechanism whereby axial separation of said retaining part from said base part is inhibited.

9. A snap together coupling device for mounting a floor maintenance pad to a drive disc on a power driven floor maintenance machine, comprising:

a) a base attached to said drive disc and including a substantially rigid engagement post, extending in an axial direction with respect to said drive disc, said post defining an engagement structure located on an outside surface of said post, said outside surface being radially outward with respect to an axis of rotation of said drive disc;

b) a retainer engageable with said bases c) alignment structure for aligning said retainer with said base as said retainer is installed on said base, said retainer defining at least a portion of said alignment structure; and, d) a releasable locking element carried by said retainer and including portions engageable with said post, such that said locking element inhibits separation of said retainer from said base when said locking element engages said post.

10. The coupling device of claim 9, wherein said post is centrally positioned on said base.

11. The coupling device of claim 9, wherein said retainer includes keepers and said locking element comprises a U-shaped spring clip loosely held by said keepers.

12. The apparatus of claim 11, wherein said spring clip includes a bridging section and a pair of elongate arms interconnected by said bridging section and extending therefrom.

13. The coupling device of claim 12, wherein said spring clip further comprises loops which define finger engageable pressure pads at ends of said elongate arms, such that squeezing said pressure pads urges said elongate arms apart in order to release the engagement between said spring clip and said post.

14. The coupling device of claim 11, wherein said keepers define slots having diverging cross-sections which expand outwardly from a radially inner region of said retainer to a radially outer region of said retainer.

15. The coupling device of claim 14, wherein said retainer and base each define fluid supply openings through which floor treating fluids can be dispensed.

16. The apparatus of claim 11, wherein said keepers define at least a portion of said alignment structure.

17. The coupling device of claim 9, wherein at least another portion of said alignment structure is formed by a circular wall surface defined by said base which is disposed in confronting alignment with another wall surface defined by said retainer when said retainer is engaged with said base.

18. A snap together coupling device for mounting a floor maintenance pad to a drive disc on a power driven floor maintenance machine, comprising:

a) a first coupling member forming part of said drive disc;

b) a second coupling member engageable with said first coupling member;

c) one of said coupling members including alignment structure for aligning said second coupling member with said first coupling member as said second coupling member is installed on said first coupling member;

d) one of said coupling members including a substantially rigid engagement post, extending in an axial direction with respect to said drive disc, said post defining an engagement structure located on an outside surface of said post, said outside surface being radially outward with respect to an axis of rotation of said drive disc; and, e) a locking element carried by the other of said coupling members and including portions engageable, with said post, such that said socking element inhibits separation of said first coupling member from said second coupling member when said locking element engages said post.

19. The apparatus of claim 18 wherein said first coupling member comprises a base and said second coupling member comprises a retainer.

20. The apparatus of claim 19 wherein said base is attached to said drive disc by suitable fasteners.

21. The apparatus of claim 20 wherein said base includes said engagement post and said retainer carries said locking element.

22. The apparatus of claim 18 wherein said first coupling member is molded into said drive disc.

23. The apparatus of claim 18 wherein said alignment structure comprises a hub defined by an axially depending wall.

24. The apparatus of claim 18 wherein said alignment structure comprises arcuate segments defined by confronting keepers.

25. A snap together coupling device for mounting a floor maintenance pad having a circular mounting hole to a drive disc on a power driven floor maintenance machine, the coupling device comprising:

a) a base portion forming part of and having an axis of rotation substantially coincident with an axis of rotation of said drive disc;

b) a retainer portion engageable with said base portion;

c) one of said base and retainer portions including a substantially rigid, axially extending post having at least one recess, located on a radially outward periphery of said post with respect to said axis of rotation of said drive disc;

d) a retaining mechanism carried by the other of said base and retainer portions and engageable with said one recess of said axially extending post whereby said base portion is inhibited from separating from said retainer portion.

26. The apparatus of claim 25 wherein one of said base and retainer portions defines receiving structure for a hub defined by said other one of said base and retainer portions whereby said base and retainer portions are centered with respect to each other during installation.

27. The apparatus of claim 25 wherein said retaining mechanism is carried by said retainer portion.

28. The apparatus of claim 25 wherein said base portion is a separate member, secured to said drive-disc.

29. The apparatus of claim 25 wherein said base portion is integrally formed in said drive disc.

30. The apparatus of claim 18, wherein said post includes a multiple shoulders, each of said shoulders forming at least a portion of a recess and said retaining mechanism comprises a resilient element having portions engageable with one of said recesses.

31. The apparatus of claim 25, wherein said post includes a plurality of axially spaced recesses, each recess being engageable by portions of said retaining mechanism whereby axial separation of said retaining part from said base part is inhibited.

32. A snap together coupling device for mounting a floor maintenance pad having a circular mounting hole to a drive disc on a power driven floor maintenance machine, the coupling device comprising:

a) a base part mounted for rotation with the drive disc and having at least one, substantially rigid, axially extending locking post, said post defining an engagement structure located on an outside surface of said post, said outside surface being radially outward with respect to an axis of rotation of said drive disc;

b) a retainer part defining base receiving structure located in spaced relation to said locking post, whereby said retainer part is centered with respect to said post;

c) a spring clip carried by said retainer part and having portions engageable with engagement structure defined by said locking post whereby said base is inhibited from separating from said retainer.

33. The apparatus of claim 32, wherein said post includes a shoulder and said spring clip includes resilient legs engageable with an underside of said shoulder.

34. A snap together coupling device for mounting a floor maintenance pad having a circular mounting hole to a drive disc on a power driven floor maintenance machine, the coupling device comprising:

a) a base part mountable co-axially to the drive disc and having at least one multi-stepped, axially extending post;

b) a retainer part defining a base aligning structure whereby said retainer part is positioned in predetermined alignment with respect to said post;

c) a retaining mechanism carried by said retainer part and engageable with stepped structure defined by said post whereby said base is inhibited from separating from said retainer.

35. The apparatus of claim 34, wherein said stepped, post includes two axially spaced recesses, either of which are engageable by said retaining mechanism.

36. The apparatus of claim 34, wherein said stepped post includes three axially spaced recesses, any of which are engageable by said retaining mechanism.

37. A snap together coupling device for mounting a floor maintenance pad having a circular mounting hole to a drive disc on a power driven floor maintenance machine, the coupling device comprising:

a) a base part mountable co-axially to the drive disc and having at least one, substantially rigid, axially extending post, said post defining an engagement structure located on an outside surface of said post, said outside surface being radially outward with respect to an axis of rotation of said drive disc;

b) a retainer part defining base alignment structure engageable with said base as said retainer part is being mounted to said base whereby said retainer part is positioned in predetermined alignment with respect to said base part;

c) a retaining mechanism carried by said retainer part and engageable with said engagement structure on said post whereby said base part is inhibited from separating from said retainer part.

38. The coupling device of claim 37, wherein said post has an axis that is coincident with a rotational axis of said base part.

39. The apparatus of claim 37, wherein said engagement structure on said post includes at least one recess and said retaining mechanism comprises a spring clip having at least one engagement leg engageable with said recess, when said retainer part is mounted to said base part.

40. The apparatus of claim 37 wherein said engagement structure on said post includes spaced apart, multiple recesses and said retaining mechanism comprises a spring clip having at least one engagement leg engageable with any one of said recesses.

41. The apparatus of claim 40, wherein said engagement structure on said post includes two axially spaced recesses.

42. The apparatus of claim 41, wherein said axially extending post is located centrally with respect to said base part and said alignment structure comprises at least one surface defined by a keeper which cooperates with said post.

43. The apparatus of claim 40, wherein said engagement structure on said post includes three axially spaced recesses.

44. The apparatus of claim 37, wherein said axially extending post is located centrally with respect to said base part and said alignment structure comprises an axial flange spaced from said post.

45. The apparatus of claim 44, wherein said axial flange is continuous.

* * * * *